US006224502B1

(12) United States Patent
Warfield

(10) Patent No.: US 6,224,502 B1
(45) Date of Patent: May 1, 2001

(54) BALL MARK REPAIR IMPLEMENT

(75) Inventor: Grant I. Warfield, 8991 Ferndale La., Eden Prairie, MN (US) 55347

(73) Assignee: Grant I. Warfield, Eden Prairie, MN (US)

( * ) Notice: Subject to any disclaimer, the term of this patent is extended or adjusted under 35 U.S.C. 154(b) by 0 days.

(21) Appl. No.: 09/461,850

(22) Filed: Dec. 15, 1999

(51) Int. Cl.[7] ..... K63B 57/00
(52) U.S. Cl. ..... 473/408
(58) Field of Search ..... 473/408, 286; D21/793; 172/378

(56) References Cited

U.S. PATENT DOCUMENTS

| | | | | |
|---|---|---|---|---|
| D. 422,664 | * | 4/2000 | Tate | D21/793 |
| D. 434,825 | * | 12/2000 | Miura | D21/793 |
| 3,185,483 | | 5/1965 | Klynman | 473/408 |
| 4,007,928 | | 2/1977 | Doubt . | |
| 4,787,632 | | 11/1988 | Nigrelli et al. . | |
| 4,951,951 | | 8/1990 | Meyer . | |
| 4,960,239 | | 10/1990 | Wait . | |
| 4,984,790 | * | 1/1991 | Dowdy et al. | 473/408 |
| 5,022,650 | | 6/1991 | Madock . | |
| 5,121,519 | | 6/1992 | Haugom . | |
| 5,209,469 | | 5/1993 | Laskowitz et al. . | |
| 5,211,395 | | 5/1993 | Liao . | |
| 5,226,647 | | 7/1993 | Notarmuzi . | |
| 5,269,513 | | 12/1993 | Gervais . | |
| 5,401,019 | | 3/1995 | Wissman et al. . | |
| 5,529,299 | | 6/1996 | Bellagamba | 473/285 |
| 5,643,113 | | 7/1997 | Rodgers | 473/386 |
| 5,643,114 | | 7/1997 | Marcus | 473/408 |
| 5,645,500 | | 7/1997 | Borden | 473/408 |
| 5,759,120 | | 6/1998 | Mathis et al. | 473/408 |
| 5,765,647 | | 6/1998 | Hood | 172/371 |
| 5,788,197 | * | 8/1998 | Tutela | 473/408 |

* cited by examiner

*Primary Examiner*—Steven Wong
(74) *Attorney, Agent, or Firm*—Faegre & Benson LLP

(57) ABSTRACT

An implement for repairing ball marks on golf greens, the implement having a grasping portion at a proximal end and at least one prong at a distal end with a ramp-like profile ending in a transversely oriented abutment in a mediate region. The abutment provides a surface against which an index finger of a user can rest to apply increased pressure to insert the implement into a golf green. The method of using the implement includes inserting the implement adjacent the ball mark and moving turf laterally. In those instances where insertion of the ramp-like prong or prongs is insufficient to repair the damage of the ball mark, the method further includes rocking the implement about the distal end to move the turf laterally.

16 Claims, 5 Drawing Sheets

BALL MARK REPAIR IMPLEMENT

BACKGROUND OF THE INVENTION

In the past, there have been many attempts to provide an implement to repair ball marks caused by golf balls landing on golf course greens. Such marks are typically a dimple, with or without peripheral scuffing in the grass of the green. Left unrepaired, such marks result immediately in an uneven surface for subsequent players, and eventually damage the grass surface of the green. Furthermore, improper repair of such marks can result in damage to the grass. Even though many efforts have been addressed in the prior art, there remains a need to enable quick and effective repair in a variety of conditions, using a relatively simple and readily available implement.

DETAILED DESCRIPTION OF THE INVENTION

Figure 1:
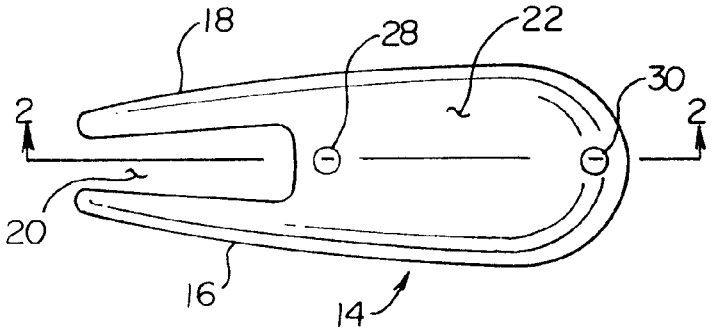
Fig. 1 PRIOR ART
FIG. 1 is a top plan view of a prior art repair device.
Figure 2:
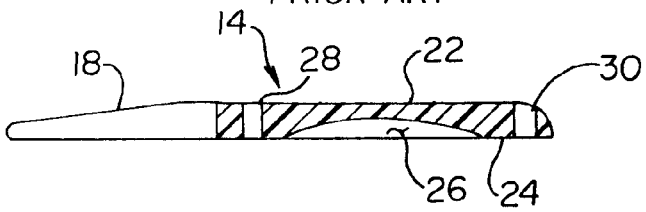
Fig. 2 PRIOR ART
FIG. 2 shows a section view taken along line 2—2 of FIG. 1.
Figure 3:
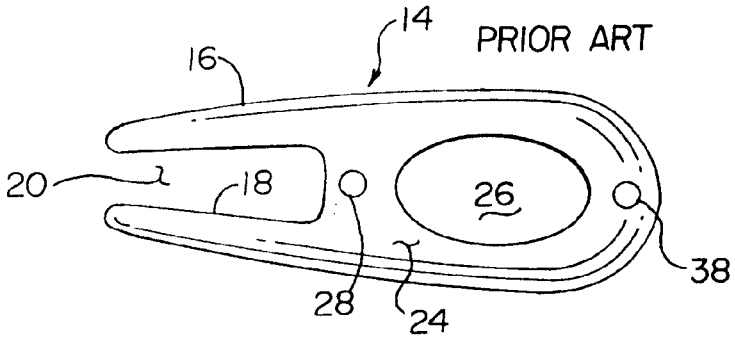
Fig. 3 PRIOR ART
FIG. 3 is a bottom plan view of the device of FIG. 1.
Figure 4:
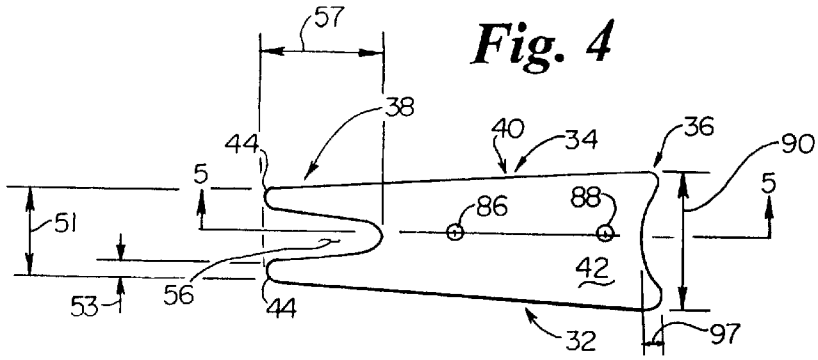
FIG. 4 is a top plan view of a ball mark repair implement useful in the practice of the present invention.
Figure 5:
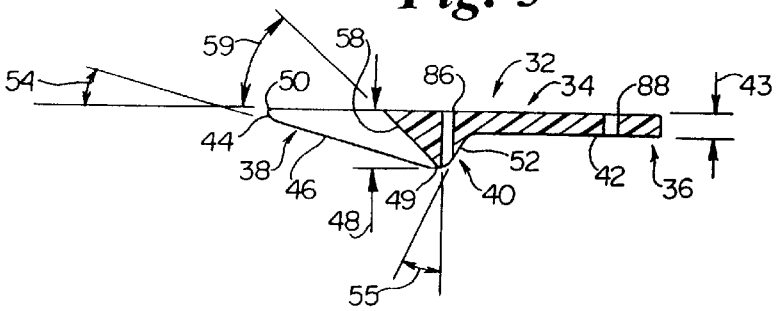
FIG. 5 is a section view taken along line 5—5 of FIG. 4.
Figure 6:
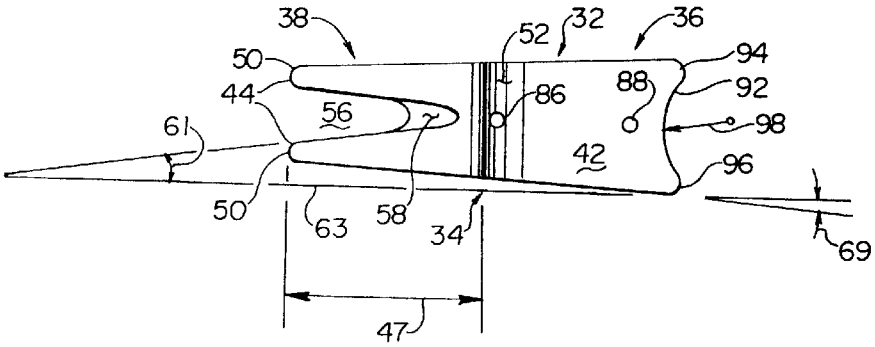
FIG. 6 is a bottom plan view of the implement of FIG. 4.
Figure 7:
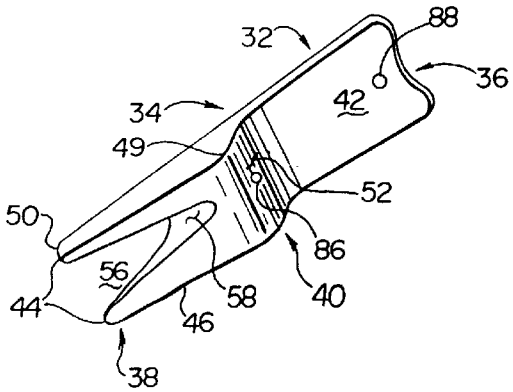
FIG. 7 is a perspective view of the implement of FIG. 4.

Referring to the Figures, and most particularly to FIGS. 1–3, a prior art device 14 may be seen. Prior art device 14 has a pair of projections 16, 18 separated by a recess 20. Device 14 has a generally planar top surface 22 and a generally planar bottom surface 24. An elliptical depression 26 is formed in bottom surface 24 to provide a convenient thumb rest for a person using the device. A pair of through holes 28, 30 allow for attachment of the device 14 to something else, and permit a ball marker (not shown) to be carried by device 14. As may be seen most clearly in FIG. 2, this device does not have any thickened portion wider than any other portion.

Referring now most particularly to FIGS. 4–7, a ball mark repair implement 32 according to the present invention may be seen. Implement 32 preferably has a body 34 with a proximal end 36, a distal end 38 and a mediate region 40 between the proximal and distal ends 36, 38. A grasping portion 42 in the form of a flat, thick blade or tab with a characteristic thickness 43 is preferably located at the proximal end 36. The implement 32 is preferably 2 ⅞ inches long overall.

A pair of prongs 44 are located at the distal end 38. Each prong preferably has a ramp-like cross section or portion 46 with a maximum thickness 48 greater than the thickness of the grasping portion 42. The ramp-like portion 46 preferably extends from a tip 50 at the distal end 38 to an abutment means or transversely oriented wall 52 in the mediate region 40. The abutment means 52 provides the function of providing a transversely oriented surface to enable increased pressure to be applied to the prongs when the repair implement is inserted into a golf green to repair damage due to a ball mark. The ramp preferably has an incline angle 54 within a range of 10 to 25 degrees, with a most preferred angle of 15 degrees. The abutment means or wall 52 preferably has an angle 55 of 30 degrees with respect to a perpendicular to the plane of the grasping region or surface 42. The distance 47 from the prong tips to the wall 52 is preferably 1 ¼ inches. The radius of the corner 49 joining the wall 52 to the ramp 46 is preferably ⅛ inch.

In this embodiment, the prongs 44 are preferably separated by a space 56 which tapers slightly from the distal end 38 towards the mediate region 40. Space 56 preferably extends a distance from the prong tips back 11/16 inch from the distal end. The taper angle 61 of the space 56 is preferably 11 degrees with respect to a longitudinal axis 63 of the implement 32. The taper angle 69 of the outside edges of implement 32 is preferably 4 degrees with respect to longitudinal axis 63. The lateral distance 51 from the outside of one prong to the other prong is preferably 19/32 inches and each prong preferably has a radius of 3/64 inches, giving a prong width 53 of 3/32 inches. It has been found that such a space makes it easier to insert the implement into relatively hard golf greens. Furthermore, the space 56 has a beveled relief 58 at the mediate region end thereof preferably at an angle 59 of 30 degrees, to further assist in insertion of the prongs 44.

The grasping portion 42 is preferably relatively flat with generally planar outer surfaces and preferably has a thickness 43 of ⅛ inch. A pair of holes 86, 88 each having a diameter of 3/32 inches preferably pass through implement 32 for manufacturing purposes, providing a pair of locations for extracting pins to withdraw the implement 32 from a mold cavity. The proximal end 36 preferably has a maximum width 90 of 1 inch with a concave region 92 between two convex corners 94, 96, with a setback 97 of the concave region of preferably 1/16 inch. The concave region preferably has a radius 98 of 11/16 inch and the convex corners each preferably have a ⅛ inch radius.

Figure 8:
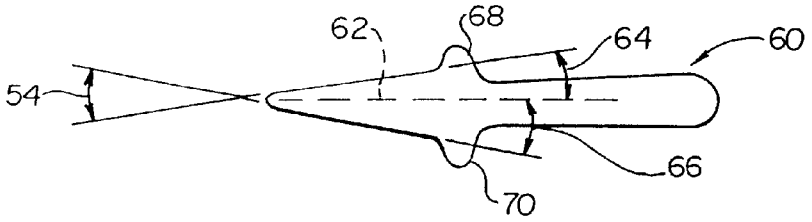
FIG. 8 is a side view of an alternative embodiment of an implement useful in the practice of the present invention.

Referring now most particularly to FIG. 8, a second embodiment 60 of the implement of the present invention may be seen. In this embodiment, the incline angle 54 is preferably symmetrical about a central axis 62 of the implement, with angles 64, 66 (each equal to one half the incline angle 54) extending about opposite sides of the central axis 62. A pair of projecting walls 68, 70 preferably extend laterally away from the mediate portion of the body of the implement in this embodiment. Alternatively, this embodiment 60 with the symmetrical incline angle 54 may have only one projecting wall 68 or 70.

Figure 9:
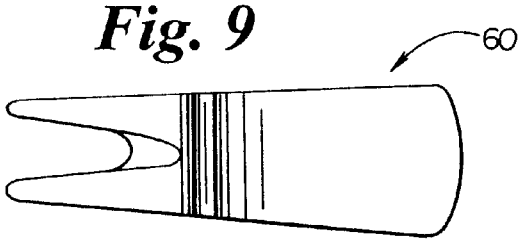
FIG. 9 is s plan view of the implement of FIG. 8.

Referring now also to FIG. 9, implement 60 is similar in plan view to the implement 32.

Figure 10:
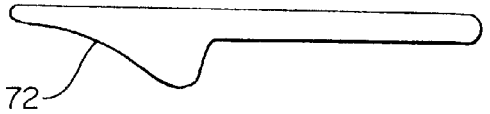
FIG. 10 is a side view of a further alternative embodiment of the present invention with a concave ramp-like slope.
Figure 11:
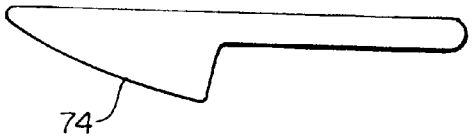
FIG. 11 is a side view of a still further alternative embodiment of the present invention with a convex ramp-like slope.
Figure 12:
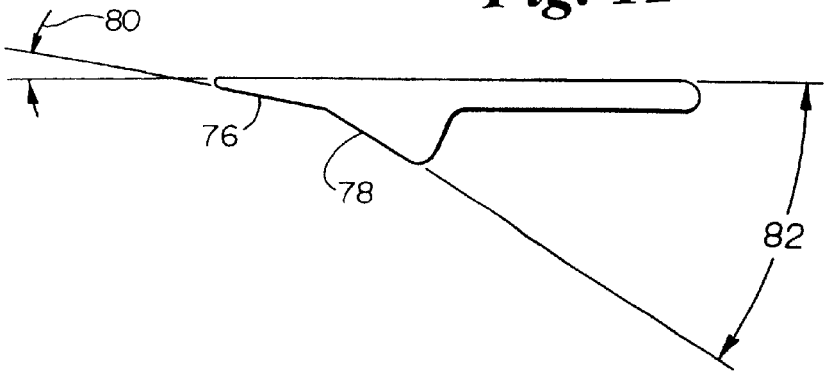
FIG. 12 is a side view of another embodiment of the present invention with a ramp-like slope made up of a plurality of segments.
Figure 13:
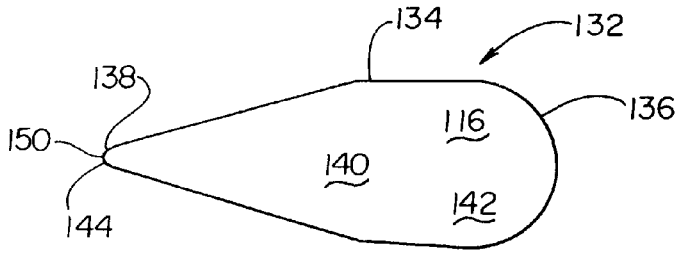
FIG. 13 is a top plan view of an alternative ball mark repair implement having only one prong useful in the practice of the present invention.
Figure 14:
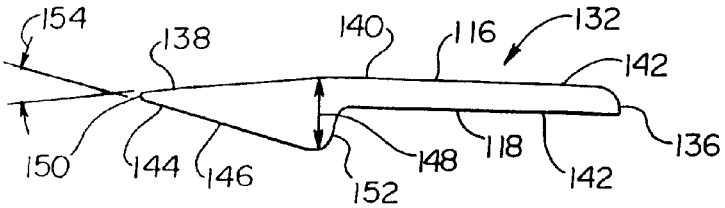
FIG. 14 is a side view of the implement shown in FIG. 13.

Referring now to FIGS. 10, 11, and 12, various additional embodiments of the present invention may be seen. In FIG. 10, the ramp 72 is characteristically concave. FIG. 11 shows an implement with a convex ramp 74, while FIG. 12 illustrates that the ramp-like cross section may be made up of a plurality of segments 76, 78. It is to be understood that FIG. 12 is illustrative only, and that more or different segments may be included in the ramp of the implement while staying within the scope of the present invention. Segment 76 preferably has an incline angle 80 of 7½ degrees and segment 78 preferably has an incline angle 82 of 15 degrees.

Referring now to FIGS. 13–16, a still further embodiment 132 of the present invention may be seen. Implement 132 preferably has a body 134 with a proximal end 136, a distal end 138 and a mediate region 140 between the proximal and distal ends 136, 138. A grasping portion 142 in the form of a flat, thick blade or tab with a characteristic thickness 143 is preferably located at the proximal end 136.

Figure 15:
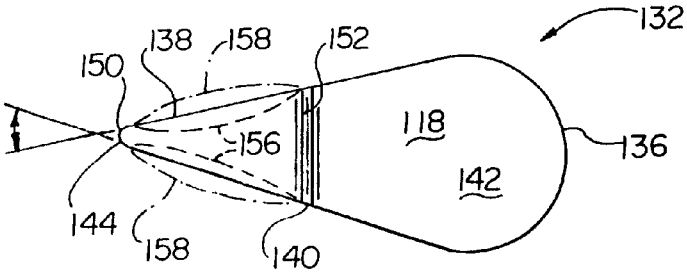
FIG. 15 is a bottom plan view of the implement shown in FIG. 13.
Figure 16:
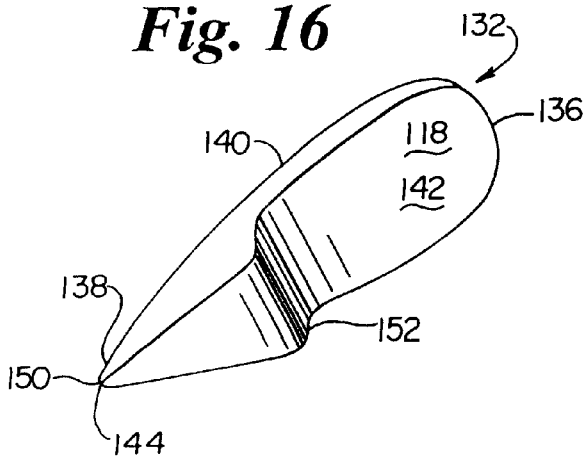
FIG. 16 is a perspective view of the implement shown in FIG. 13.

In this embodiment, a single prong 144 is located at the distal end 138. Prong 144 preferably has a ramp-like cross section or profile 146 with a maximum thickness 148 greater than the thickness of the grasping portion 142. The ramp-like profile 146 preferably extends from a tip 150 at the distal end 138 to an abutment means or transversely oriented wall or surface 152 in the mediate region 140. As in other embodiments, the abutment means 152 provides the function of providing a transversely oriented surface against which a golfer's index finger may be placed (preferably between the first and second knuckle) to enable the golfer to apply increased pressure to the prong to insert the repair implement into a golf green to repair damage due to a ball mark. The ramp-like profile 146 preferably has an incline angle 154 within a range of 10 to 25 degrees, with a most preferred angle of 15 degrees. As with other embodiments, the grasping portion 142 is preferably relatively flat with generally planar outer surfaces 116, 118. It is to be understood that implement 132 may have ramp profiles similar or identical to those shown in FIGS. 10–12, and further may have a concave plan view profile as shown in FIG. 15 by dashed lines 156, or it may have a convex plan view profile as shown in FIG. 15 by dot-dashed lines 158 or it may have other plan view profiles, such as a segmented profile (not shown). Furthermore, the implement 132 may be formed in a symmetrical form with a profile identical or similar to that shown in FIG. 8.

Figure 17:
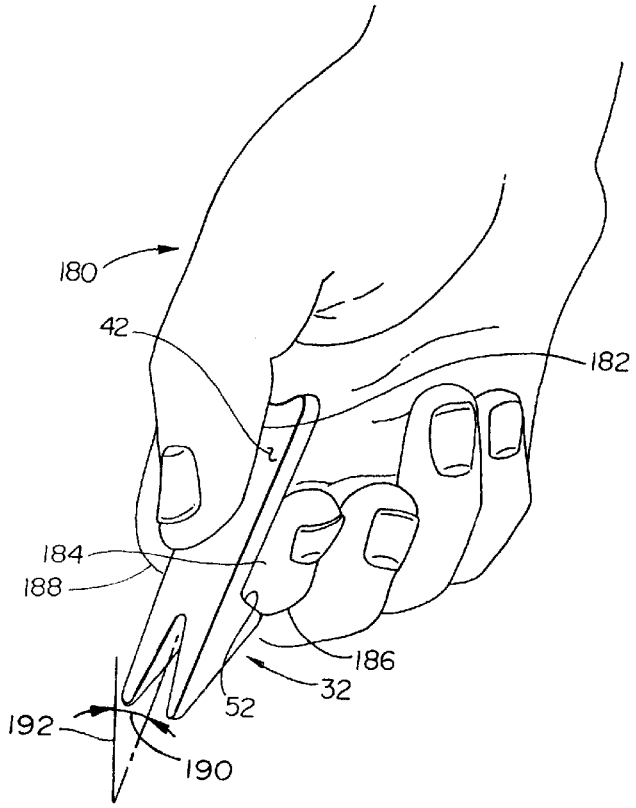
FIG. 17 is a perspective view of a hand grasping the implement of FIGS. 4–7, illustrating certain aspects of the present invention and its use.
Figure 18:
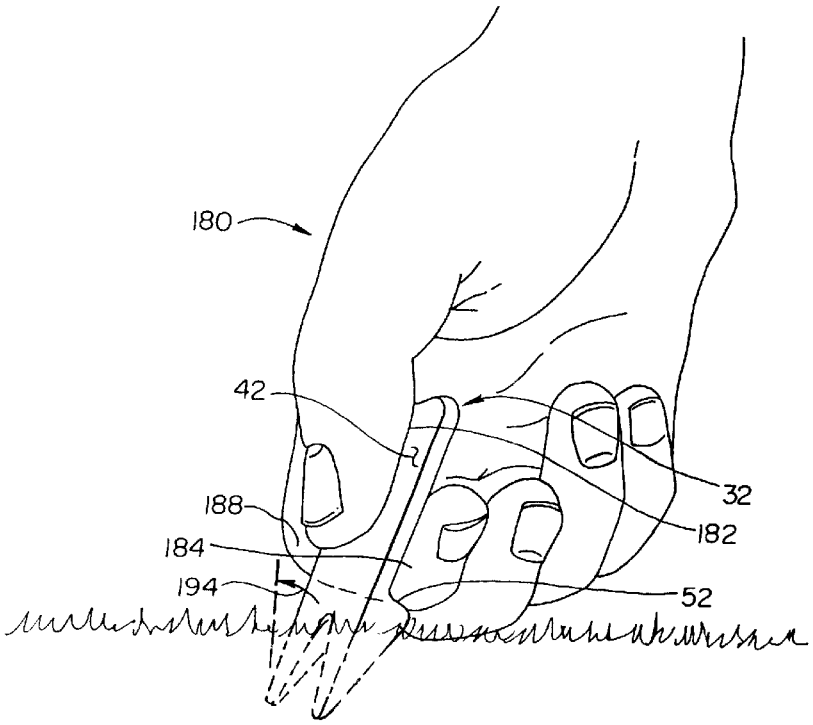
FIG. 18 is a fragmentary view similar to that of FIG. 17 with the implement inserted into a golf green adjacent a ball mark and illustrating a method of using the present invention.

Referring now most particularly to FIGS. 17 and 18, certain aspects of the use of the present invention are illustrated. While one embodiment of implement 32 is shown in these Figures, it is to be understood that other embodiments of the implement are to be used in the same or a similar manner as that described hereinafter. Furthermore, while a right hand is illustrated, it is also to be understood that the present invention is equally adaptable for use with a left hand. In FIG. 17, the hand 180 is shown grasping the implement 32 with the grasping portion 42 held between a thumb 182 and an index finger 184, most desirably with the index finger 184 resting against the transverse wall 52, and preferably between the first knuckle 186 and a second knuckle 188 of the index finger 184. Alternatively, (but less desirably) another digit of the hand such as the thumb may be placed against the transverse wall 52 to apply increased pressure to insert the implement 32 into the turf for repairing ball mark damage to a golf green.

In a number of instances, particularly where the damage associated with the ball mark is less pronounced, a simple, generally linear insertion of the implement may be sufficient to repair the damage because the ramp profile will laterally displace the turf as the prong or prongs are inserted into the turf. It is believed that the insertion angle 190 (taken with respect to a vertical direction 192) is preferably between about 20 degrees and about 70 degrees. It is further to be understood that a large insertion angle (with a generally linear insertion movement) is preferable for shallow ball mark depressions. With a large insertion angle, the wedging action of the ramp profile will raise the ball mark depression, restoring the golf green to a desirable condition. In those instances where such (generally) linear insertion is insufficient to fully repair the damage, it is further within contemplation of the method of using the present invention to initially generally linearly insert the implement, and then rock the implement generally about the tip forward towards the ball mark damage as indicated by arrow 194 in FIG. 18, to move the turf laterally by a distance greater than that achieved by the linear insertion alone. Finally, it may be found desirable to tamp the turf to level the golf green after the above restorative process has been performed (whether or not the rocking step is included).

The implement of the present invention is preferably made by injection molding a thermoplastic polymer material (generally referred to as "plastic" materials in common parlance), most particularly ABS (acrylonitrile-butadiene-styrene copolymer), but it is to be understood that the implement may be made of any other suitable material, such as, but not limited to, wood, metal, or a composite. It is further believed that the implement of the present invention may also be made of paper, one or more metal alloys, an intermetallic material, a ceramic (including glass), or a combination of materials. The implement may also be made using any other suitable manufacturing technique, as desired and appropriate.

This invention is not to be taken as limited to all of the details thereof as modifications and variations thereof may be made without departing from the spirit or scope of the invention.

What is claimed is:

1. An implement for repairing ball marks in a golf green, the implement comprising:

a. a body having a proximal end, a distal end, and a mediate region therebetween;

b. a grasping portion at the proximal end;

c. at least one prong at the distal end, the at least one prong having a ramp-like cross section with a maximum thickness greater than the thickness of the grasping portion; and d. abutment means located on the body in the mediate region for providing a transversely oriented surface to enable increased pressure to be applied to the at least one prong upon insertion of the implement into a damaged portion of the golf green.

2. The implement of claim 1 wherein the ramp-like cross section has an incline angle within a range of about 10 to about 25 degrees.

3. The implement of claim 1 wherein the ramp-like cross section has an incline angle of about 15 degrees.

4. The implement of claim 1 wherein the at least one prong comprises a pair of prongs.

5. The implement of claim 1 wherein the grasping portion has a generally planar top surface, and the maximum thickness of the ramp-like cross section extends beyond the plane of the top surface of the grasping portion on only one side of the body.

6. The implement of claim 1 wherein the grasping portion has a generally planar outer surfaces, and the maximum thickness of the ramp-like cross section extends beyond the planes of the outer surfaces of the grasping portion on both sides of the body.

7. The implement of claim 1 wherein the body is generally symmetrical about a central plane.

8. The implement of claim 7 wherein the abutment means further comprises a projection extending away from the mediate portion of the body.

9. The implement of claim 1 wherein the abutment means further comprises a projection extending away from the mediate portion of the body.

10. The implement of claim 1 wherein the ramp-like cross section has an outer surface that is generally linear.

11. The implement of claim 1 wherein the ramp-like cross section has an outer surface that is at least partially convex.

12. The implement of claim 1 wherein the ramp-like cross section has an outer surface that is at least partially concave.

13. The implement of claim 1 wherein the ramp-like cross section has an outer surface that is made up of a plurality of segments.

14. The implement of claim 13 wherein the segments are each generally linear.

15. The implement of claim 1 wherein the body comprises a thermoplastic polymer.

16. The implement of claim 15 wherein the thermoplastic polymer comprises an ABS copolymer.

* * * * *